US007338629B2

(12) United States Patent
Crafton et al.

(10) Patent No.: US 7,338,629 B2
(45) Date of Patent: Mar. 4, 2008

(54) INTEGRATED METAL PROCESSING FACILITY

(75) Inventors: Scott P. Crafton, Marietta, GA (US); Paul M. Crafton, Kennesaw, GA (US); James L. Lewis, Jr., Calabash, NC (US); Ian French, Kennesaw, GA (US)

(73) Assignee: Consolidated Engineering Company, Inc., Kennesaw, GA (US)

( * ) Notice: Subject to any disclaimer, the term of this patent is extended or adjusted under 35 U.S.C. 154(b) by 25 days.

(21) Appl. No.: 11/142,046

(22) Filed: Jun. 1, 2005

(65) Prior Publication Data

US 2005/0269751 A1 Dec. 8, 2005

Related U.S. Application Data

(63) Continuation-in-part of application No. 10/051,666, filed on Jan. 18, 2002, now abandoned.

(60) Provisional application No. 60/266,357, filed on Feb. 2, 2001, provisional application No. 60/576,107, filed on Jun. 2, 2004.

(51) Int. Cl.
*C21D 1/74* (2006.01)

(52) U.S. Cl. ..... 266/90; 266/252

(58) Field of Classification Search ..... 266/249, 266/252, 90
See application file for complete search history.

(56) References Cited

U.S. PATENT DOCUMENTS

| | | | | |
|---|---|---|---|---|
| 2,385,962 | A | 10/1945 | Barnett | 34/13 |
| 2,813,318 | A | 11/1957 | Horth | 22/89 |
| 2,988,351 | A | 6/1961 | Barnett et al. | 263/40 |
| 3,194,545 | A | 7/1965 | Smith | 266/3 |
| 3,222,227 | A | 12/1965 | Baugh et al. | 148/11.5 |
| 3,432,368 | A | 3/1969 | Nakamura | 148/12 |
| 3,534,946 | A | 10/1970 | Westerkamp et al. | 263/28 |
| 3,604,695 | A | 9/1971 | Steeper | 266/5 T |
| 3,675,905 | A | 7/1972 | Placek | 263/2 |
| 3,737,280 | A | 6/1973 | Cromp | 432/14 |
| 3,760,800 | A | 9/1973 | Staffin et al. | 128/24.1 |
| 3,794,232 | A | 2/1974 | Petri | 226/50 |
| 3,856,583 | A | 12/1974 | Sanders et al. | 148/159 |
| 3,871,438 | A | 3/1975 | Vissers et al. | 164/5 |
| 3,977,911 | A | 8/1976 | Takase | |
| 3,996,412 | A | 12/1976 | Schaefer et al. | 13/20 |
| 4,021,272 | A | 5/1977 | Asai et al. | 148/15 |
| 4,027,862 | A | 6/1977 | Schaefer et al. | 266/160 |

(Continued)

FOREIGN PATENT DOCUMENTS

| | | | |
|---|---|---|---|
| CA | 1197981 | 12/1985 | 38/18 |

(Continued)

OTHER PUBLICATIONS

Economical Used Energy Type Continuing Heat Treating Furnace For Aluminum Castings Dogyo—Kanetsu vol. 21 No. 2 pp. 29-36—Mar. 1984.

(Continued)

*Primary Examiner*—Scott Kastler
(74) *Attorney, Agent, or Firm*—Womble Carlyle Sandridge & Rice, PLLC

(57) ABSTRACT

A system and method for forming and heat treating a metal casting are provided.

11 Claims, 8 Drawing Sheets

U.S. PATENT DOCUMENTS

| | | | | |
|---|---|---|---|---|
| 4,068,389 | A | 1/1978 | Staffin et al. | 34/57 A |
| 4,098,624 | A | 7/1978 | Laird, Jr. | 148/153 |
| 4,140,467 | A | 2/1979 | Ellison et al. | 432/72 |
| 4,161,389 | A | 7/1979 | Staffin et al. | 432/58 |
| 4,177,085 | A | 12/1979 | Chadwick et al. | 148/2 |
| 4,177,952 | A | 12/1979 | Rikker | 241/40 |
| 4,211,274 | A | 7/1980 | Slowinski et al. | 164/401 |
| 4,242,077 | A | 12/1980 | Hyre | 431/19 |
| 4,255,133 | A | 3/1981 | Tanifuji et al. | 432/24 |
| 4,257,767 | A | 3/1981 | Price | 432/24 |
| 4,294,436 | A | 10/1981 | Takahashi | 266/257 |
| 4,325,424 | A | 4/1982 | Scheffer | 164/5 |
| 4,338,077 | A | 7/1982 | Shibayama et al. | 432/11 |
| 4,340,433 | A | 7/1982 | Harding | 148/16 |
| 4,357,135 | A | 11/1982 | Wilde et al. | 432/11 |
| 4,392,814 | A | 7/1983 | Harding | 431/170 |
| 4,411,709 | A | 10/1983 | Nakanishi | 148/3 |
| 4,415,444 | A | 11/1983 | Guptail | 209/3 |
| 4,419,143 | A | 12/1983 | Ito et al. | 148/3 |
| 4,420,345 | A | 12/1983 | Ito et al. | 148/3 |
| 4,457,352 | A | 7/1984 | Scheffer | 164/5 |
| 4,457,788 | A | 7/1984 | Staffin et al. | 148/20.3 |
| 4,457,789 | A | 7/1984 | Wilks | 148/134 |
| 4,478,572 | A | 10/1984 | Selli | 432/13 |
| 4,490,107 | A | 12/1984 | Kimura et al. | 422/11 |
| 4,499,940 | A | 2/1985 | Hall | 164/36 |
| 4,512,821 | A | 4/1985 | Staffin et al. | 146/165.5 |
| 4,519,718 | A | 5/1985 | Staffin et al. | 374/45 |
| 4,524,957 | A | 6/1985 | Staffin et al. | 266/252 |
| 4,544,013 | A | 10/1985 | Kearney et al. | 164/5 |
| 4,547,228 | A | 10/1985 | Girrell et al. | 148/16 |
| 4,577,671 | A | 3/1986 | Stephan | 164/401 |
| 4,579,319 | A | 4/1986 | Sasaki | 266/252 |
| 4,582,301 | A | 4/1986 | Wunning | 266/87 |
| 4,604,055 | A | 8/1986 | Mackenzie | 432/58 |
| 4,606,529 | A | 8/1986 | Tooch | 266/80 |
| 4,613,713 | A | 9/1986 | Staffin et al. | 585/241 |
| 4,620,586 | A | 11/1986 | Musschoot | 164/253 |
| 4,620,884 | A | 11/1986 | Heath | 148/128 |
| 4,623,400 | A | 11/1986 | Japka et al. | 148/6.35 |
| 4,648,836 | A | 3/1987 | Thom | 432/107 |
| 4,671,496 | A | 6/1987 | Girrell et al. | 266/78 |
| 4,681,267 | A | 7/1987 | Leidel et al. | 241/23 |
| 4,700,766 | A | 10/1987 | Godderidge | 164/5 |
| 4,752,061 | A | 6/1988 | Dalton et al. | 266/87 |
| 4,779,163 | A | 10/1988 | Bickford et al. | 361/212 |
| 4,817,920 | A | 4/1989 | Erfort, Jr. | 266/252 |
| 4,830,605 | A | 5/1989 | Hodate et al. | 431/170 |
| 4,832,764 | A | 5/1989 | Merz | 148/131 |
| 4,878,952 | A | 11/1989 | Pillhoefer | 148/1 |
| 4,955,425 | A | 9/1990 | McKenna | 164/269 |
| 5,018,707 | A | 5/1991 | Hemsath et al. | 266/254 |
| 5,108,519 | A | 4/1992 | Armanie et al. | 148/12.7 A |
| 5,108,520 | A | 4/1992 | Liu et al. | 148/12.7 R |
| 5,115,770 | A | 5/1992 | Yen et al. | 123/193.6 |
| 5,120,372 | A | 6/1992 | Yen et al. | 420/537 |
| 5,156,800 | A | 10/1992 | Buchet et al. | 266/99 |
| 5,169,913 | A | 12/1992 | Staffin et al. | 526/65 |
| 5,178,695 | A | 1/1993 | LaSalle et al. | 148/698 |
| 5,226,983 | A | 7/1993 | Skinner et al. | 148/549 |
| 5,251,683 | A | 10/1993 | Backer | 164/98 |
| 5,253,698 | A | 10/1993 | Keough et al. | 164/269 |
| 5,294,094 | A | 3/1994 | Crafton et al. | 266/44 |
| 5,306,359 | A | 4/1994 | Eppeland et al. | 148/511 |
| 5,308,410 | A | 5/1994 | Hurimura et al. | 148/561 |
| 5,312,498 | A | 5/1994 | Anderson | 148/695 |
| 5,336,344 | A | 8/1994 | Wei | 148/549 |
| 5,340,089 | A | 8/1994 | Heath et al. | 266/87 |
| 5,340,418 | A * | 8/1994 | Wei | 266/249 |
| 5,350,160 | A | 9/1994 | Crafton et al. | 266/252 |
| 5,354,038 | A | 10/1994 | Crafton | 266/44 |
| 5,378,434 | A | 1/1995 | Staffin et al. | 422/141 |
| 5,423,370 | A | 6/1995 | Bonnemersou et al. | 164/132 |
| 5,439,045 | A | 8/1995 | Crafton | 165/5 |
| 5,485,985 | A | 1/1996 | Eppeland et al. | 266/87 |
| 5,514,228 | A | 5/1996 | Wyatt-Mair et al. | 148/551 |
| 5,518,557 | A | 5/1996 | Jones et al. | 148/511 |
| 5,531,423 | A | 7/1996 | Crafton et al. | 266/44 |
| 5,536,337 | A | 7/1996 | Wei | 148/549 |
| 5,547,523 | A | 8/1996 | Blankenship, Jr. et al. | 148/677 |
| 5,551,670 | A | 9/1996 | Heath et al. | 266/87 |
| 5,551,998 | A | 9/1996 | Crafton et al. | 148/538 |
| 5,565,046 | A | 10/1996 | Crafton et al. | 148/538 |
| 5,571,347 | A | 11/1996 | Bergsma | 148/550 |
| 5,593,519 | A | 1/1997 | Blankenship, Jr. et al. | 148/514 |
| 5,643,372 | A | 7/1997 | Sainfort et al. | 148/699 |
| 5,738,162 | A | 4/1998 | Crafton | 164/5 |
| 5,829,509 | A | 11/1998 | Crafton | 164/5 |
| 5,850,866 | A | 12/1998 | Crafton | 164/5 |
| 6,112,803 | A | 9/2000 | Kruger | 164/103 |
| 6,217,317 | B1 | 4/2001 | Crafton et al. | 432/128 |
| 6,325,873 | B1 | 12/2001 | Pollkoetter | 148/552 |
| 6,672,367 | B2 | 1/2004 | Crafton et al. | |
| 6,901,990 | B2 | 6/2005 | Howard et al. | |
| 6,910,522 | B2 * | 6/2005 | Crafton et al. | 266/252 |
| 2002/0104596 | A1 | 8/2002 | Crafton et al. | |
| 2004/0035546 | A1 | 2/2004 | DiSerio | |
| 2005/0072549 | A1 | 4/2005 | Crafton et al. | |
| 2005/0257858 | A1 | 11/2005 | Crafton et al. | |
| 2005/0269751 | A1 | 12/2005 | Crafton et al. | |

FOREIGN PATENT DOCUMENTS

| | | | | |
|---|---|---|---|---|
| DE | 2307773 | | 2/1973 | |
| DE | 2323805 | | 5/1973 | |
| DE | 2310541 | | 9/1973 | |
| DE | 2315958 | | 4/1974 | |
| DE | 2337894 | | 11/1974 | |
| DE | 2914221 | | 4/1979 | |
| DE | 3206048 | | 2/1982 | |
| DE | 4012158 | | 11/1990 | 164/5 |
| DE | 195 30 975 | | 2/1997 | |
| EP | 0546210 | A1 | 6/1993 | |
| EP | 0 610 028 | | 8/1994 | |
| FR | 7043571 | | 12/1970 | |
| FR | 2448573 | | 2/1979 | |
| GB | 1392405 | | 4/1975 | |
| GB | 1564151 | | 4/1980 | |
| GB | 1569152 | | 6/1980 | |
| GB | 2187398 | | 9/1987 | |
| GB | 2230720 | | 10/1990 | |
| JP | 355149772 | A | 11/1980 | |
| JP | 5653867 | | 5/1981 | |
| JP | 5939464 | | 8/1982 | |
| JP | 5825417 | | 2/1983 | |
| JP | 5825860 | | 2/1983 | |
| JP | 59219410 | | 12/1984 | |
| JP | 6092040 | | 5/1985 | 164/132 |
| JP | 2074022 | | 9/1985 | |
| JP | 6316853 | | 1/1988 | 164/132 |
| JP | 63108941 | | 5/1988 | |
| JP | 1-91957 | | 4/1989 | |
| JP | 1-122658 | | 5/1989 | |
| JP | 2104164 | | 8/1990 | |
| JP | 62110248 | | 8/1990 | |
| JP | 3-465 | | 1/1991 | |
| SU | 1129012 | | 7/1982 | |
| SU | 0234810 | | 3/1985 | 164/132 |
| WO | WO 97/30805 | | 8/1997 | |
| WO | WO 98/14291 | | 4/1998 | |
| WO | WO 00/36354 | | 6/2000 | |
| WO | WO 02/063051 | A2 | 8/2002 | |

WO WO 2006/066314 A1 6/2006

OTHER PUBLICATIONS

Brochures describing Beardsley & Pipe PNEU-RECLAIM Sand Reclamation Units Prior to Aug. 13, 1992.
Brochure describing Fataluminum Sand Reclamation Units—Prior to Aug. 13, 1992.
ASM Handbook, vol. 4 Heat Treating, pp. 465-474, Apr. 1993.
Paul M. Crafton—Heat Treating Aging System Also Permits Core Sand Removal—Reprinted from Sep. 1989 Modern Castings magazine.
The Making, Shaping and Treating of Steel, 10th edition, pp. 1267-1276, Dec. 1989.
Sales brochure describing Thermfire Brand Sand Reclamation, Gudgeon Bros., Ltd. believed to be known to others prior to Sep. 1989.
Sales brochure describing Simplicity/Richards Gas-Fired Thermal Reclamation System Simplicity Engineering, Inc.—believed to be known to others prior to Sep. 1989.
Sales brochure describing AirTrac Brand Fluidizing Conveyor, Air Trac Systems Corp., believed to be known to others prior to Sep. 1989.
Sales brochure describing Fluid Bed Calcifer Thermal Sand Reclamation Systems, Dependable Foundry Equipment Co.—Believed to be known to others prior to Sep. 1989.
Foundry Management & Technology—Dec. 1989—vol. 117; No. 12; p. G3—Shakeout/Cleaning/Finishing Brochure.
Lampman S.R. & Zorc T.B.: "ASM Handbook—Heat Treating, vol. 4" 1991, ASM International, USA, XP-002357244—pp. 529-541, Dec. 1991.

* cited by examiner

QUENCH STATION
78
INCINERATOR
69
71
HEAT TREATMENT STATION
42
26
61
68
PROCESS TEMPERATURE CONTROL STATION
36
5
TRANSFER MECHANISM
27
60
10
12
19
m
11
21
16
18
13
17
14
23
22

HEAT TREATMENT STATION
42
79
41
86
26
36
84
83
10
81
28
82
5
34'
27
31
34
32
32'
24
29
12
10
23
21
11

HEAT TREATMENT STATION
42
26
87
CHILL REMOVAL
84
36
81
83
12
79
5
82

INTEGRATED METAL PROCESSING FACILITY

CROSS-REFERENCE TO RELATED APPLICATIONS

This application is a continuation-in-part of U.S. patent application Ser. No. 10/051,666, filed Jan. 18, 2002, now abandoned which claims the benefit of U.S. Provisional Application Ser. No. 60/266,357, filed Feb. 2, 2001, and this application further claims the benefit of U.S. Provisional Application No. 60/576,107, filed Jun. 2, 2004, each of which is incorporated by reference herein in its entirety.

BACKGROUND

Traditionally, in conventional processes for forming metal castings, a mold, such as a metal die or sand mold having an interior chamber with the exterior features of a desired casting defined therein, is filled with a molten metal. A sand core that defines interior features of the casting is received and or positioned within the mold to form the interior detail of the casting as the molten metal solidifies about the core. After the molten metal of the casting has solidified, the casting generally is moved to a treatment furnace(s) for heat treatment of the castings, removal of sand from the sand cores and/or molds, and other processing as required. The heat treatment processes condition the metal or metal alloys of the castings to achieve the desired physical characteristics for a given application.

Typically, during the transfer of the castings from the pouring station to a heat treatment station, and especially if the castings are allowed to sit for any appreciable amount of time, the castings may be exposed to the ambient environment of the foundry or metal processing facility. As a result, the castings tend to rapidly cool down from a molten or semi-molten temperature. While some cooling of the castings is necessary to allow the castings to solidify, the more the temperature of the castings drops, and the longer the castings remain below a process critical temperature (also referred to herein as the "process control temperature") of the castings, the more time is required to heat the castings up to a desired heat treatment temperature and to heat treat the castings. For example, it has been found that for certain types of metals, for every minute of time that the casting drops below its process control temperature, at least about 4 minutes of extra heat treatment time is required to achieve the desired results. Thus, even dropping below the process control temperature for the metal of the casting for as few as ten minutes may require at least about 40 minutes of additional heat treatment time to achieve the desired physical properties. Typically, therefore, the castings are heat treated for 2 to 6 hours, in some cases longer, to achieve the desired heat treatment effects. This results in greater utilization of energy and, therefore, greater heat treatment costs.

SUMMARY

Briefly described, the present invention generally comprises an integrated metal processing facility for pouring, forming, heat treating, and further processing castings formed from metals or metal alloys. The integrated metal processing facility generally includes a pouring station at which a molten metal such as aluminum or iron, or a metal alloy, is poured into a mold or die, such as a permanent metal mold, semi permanent mold, or a sand mold. The molds then are transitioned from a pouring or casting position of the pouring station to a transfer position, where the casting is either removed from its mold or transferred to a heat treatment line. The transfer mechanism typically includes a robotic arm, crane, overhead hoist or lift, pusher, conveyor, or similar conveying mechanism. The same mechanism also may be used to remove the castings from their molds and transfer the castings to the heat treatment line. During this transition from the pouring station to the transfer position and/or to the heat treatment line, the molten metal of the castings is permitted to cool to an extent sufficient to form the castings.

The heat treatment line or unit generally includes a process temperature control station and a heat treatment station or furnace typically having one or more furnace chambers and, optionally, a quench station generally located downstream from the heat treatment station. The process temperature control station generally may be an elongated chamber or tunnel through which the castings are received prior to their introduction into the heat treatment station. The chamber may include a series of heat sources, such as radiant heaters, infrared, inductive, convection, conduction, or other types of heating elements. The walls and ceiling of the process temperature control station also may include a radiant material that tends to radiate or direct heat toward the castings and/or molds as they move through the chamber. Alternatively, a series of heat sources, including radiant heating elements such as infrared and inductive heating elements, convection, conduction, or other types of heat sources may be used to direct heat at the castings or molds as the castings or molds are transferred from the pouring station to the heat treatment station. In addition, a heating element or heat source can be mounted directly to the transfer mechanism to heat the castings and/or the sand molds.

As the castings and/or the molds with the castings therein pass through the process temperature control station, cooling of the castings is arrested at or above a process control temperature. The process control temperature generally is a temperature below the solution heat treatment temperature required for the metal of the castings, such that the castings are cooled to a sufficient amount or extent to enable them to solidify, but below which the time required to raise the castings up to their solution heat treatment temperature and thereafter heat-treat the castings is increased exponentially. The castings are maintained at or above their process control temperature until the castings enter the heat treatment station.

By arresting the cooling of the castings and thereafter maintaining the castings at a temperature that is substantially at or above the process control temperature for the metal of the castings, the time required to heat treat the castings can be significantly reduced. Accordingly, the output of the pouring station for the castings can be increased and the overall processing and heat treatment time for the castings can be reduced.

Prior to entry into the heat treatment furnace, the castings pass through an entry zone. The temperature of the casting may be monitored to determine whether the temperature has dropped below a pre-set or predefined rejection temperature. If the temperature of the casting is equal to or less than the rejection temperature, the casting may be removed from the heat treatment line using any suitable means. If the casting is accepted, it proceeds to the heat treatment furnace for heat treatment.

The heat treatment unit may include features that assist with the removal and/or reclamation of sand core and/or mold. Thereafter, the castings may undergo additional processing, for example, quenching, aging, and/or further heat treatment.

Various objects, features, and advantages of the present invention will become apparent to those skilled in the art upon a review of the following detailed description when taken in conjunction with the accompanying drawings.

DETAILED DESCRIPTION

Referring now in greater detail to the drawings in which like numerals refer to like parts throughout the several views, FIG. 1A through FIG. 3 schematically illustrate an exemplary integrated metal processing facility or system 5 for and method of processing metallurgical castings. Metal casting processes generally are known to those skilled in the art and a traditional casting process will be described only briefly for reference purposes. It will be understood by those skilled in the art that the present invention can be used in any type of casting process, including metal casting processes for forming aluminum, iron, steel, and/or other types of metal and metal alloy castings. The present invention thus is not and should not be limited solely for use with a particular casting process or a particular type or types of metals or metal alloys.

Figures 1A, 1B, 1C:
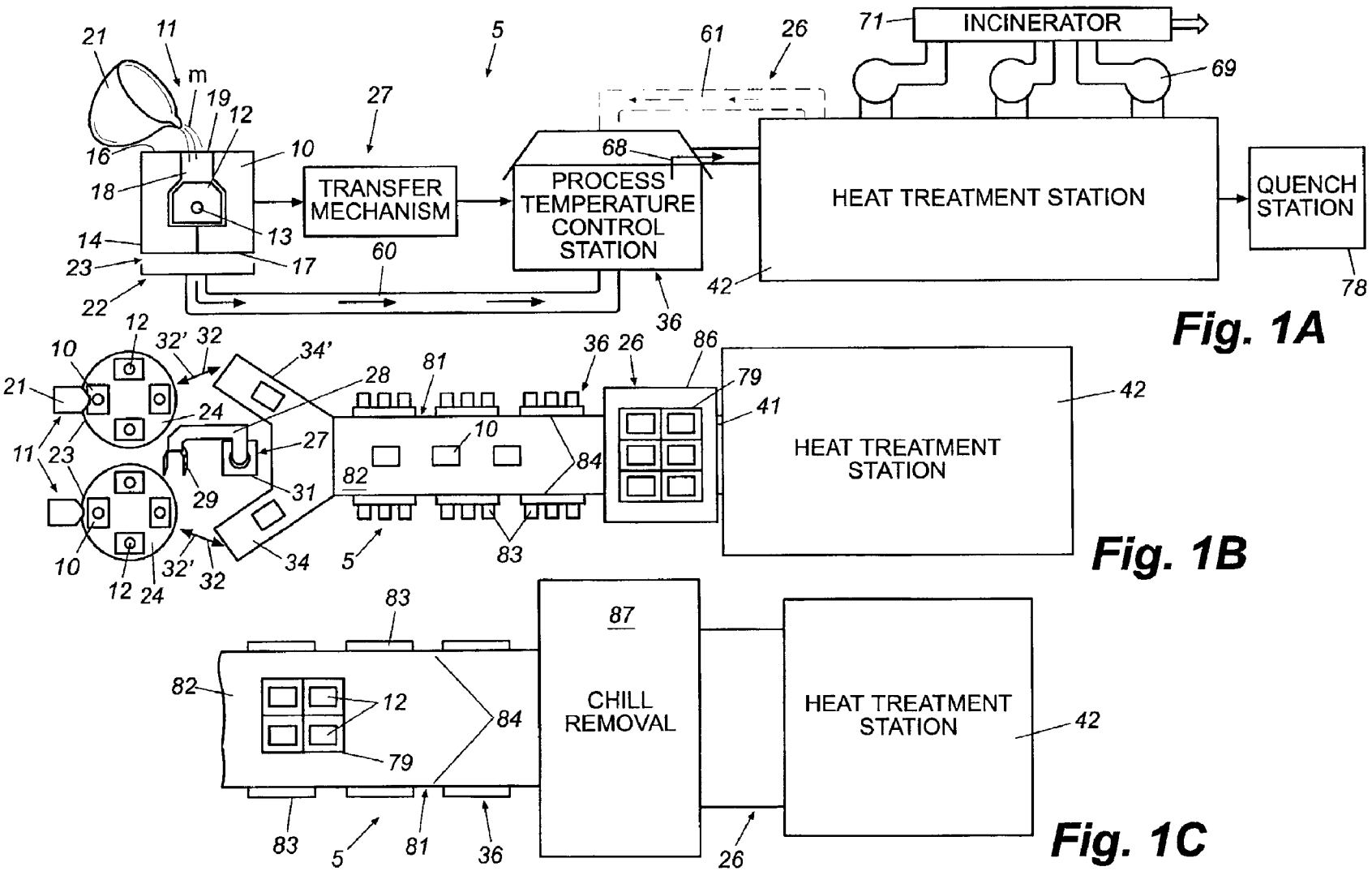
FIG. 1A is a schematic illustration of an exemplary metal processing system according to various aspects of the present invention.
FIG. 1B is a schematic illustration of another exemplary metal processing system illustrating the collection and transfer of castings from multiple pouring stations to a heat treatment unit according to various aspects of the present invention.
FIG. 1C is a schematic illustration of yet another exemplary metal processing system with chill removal from the molds according to various aspects of the present invention.

As illustrated in FIG. 1A, a molten metal or metallic alloy M typically is poured into a die or mold 10 at a pouring or casting station 11 for forming a casting 12, such as a cylinder head, engine block, or similar cast part. A casting core 13 formed from sand and an organic binder, such as a phenolic resin, is received or placed within the mold 10 to create hollow cavities and/or casting details or core prints within the casting. Each of the molds alternatively can be a permanent mold or die, typically formed from a metal such as steel, cast iron, or other material as is known in the art. Such molds may have a clam-shell style design for ease of opening and removal of the casting therefrom. Alternatively still, the molds can be "precision sand mold" type molds and/or "green sand molds", which generally are formed from a sand material such as silica sand or zircon sand mixed with a binder such as a phenolic resin or other binder as is known in the art, similar to the sand casting cores 13. The molds further may be semi-permanent sand molds, which typically have an outer mold wall formed from sand and a binder material, a metal such as steel, or a combination of both types of materials.

It will be understood that the term "mold" will be used hereafter to refer generally to all types of molds as discussed above, including permanent or metal dies, semi-permanent and precision sand mold type molds, and other metal casting molds, except where a particular type mold is indicated. It further will be understood that in the various embodiments discussed below, unless a particular type of mold and/or heat treatment process is indicated, the present invention can be used for heat treating castings that have been removed from their permanent molds, or that remain within a sand mold for the combined heat treatment and sand mold break-down and sand reclamation.

As shown in FIG. 1A, each of the molds 10 generally includes side walls 14, an upper wall or top 16, and a lower wall or bottom 17 that collectively define an internal cavity 18 in which the molten metal is received and formed into the casting 12. A pour opening 19 generally is formed in the upper wall or top 16 of each mold and communicates with the internal cavity for passage of the molten metal through each mold and into the internal cavity 18 at the pouring station 11. As indicated in FIGS. 1A through 1C, the pouring station 11 generally includes a ladle or similar mechanism 21 for pouring the molten metal M into the molds. The pouring station 11 further includes a conveyor 22, such as a carousel, piston, indexing, or similar conveying mechanism that moves one or more molds from a pouring or casting position 23, where the molten metal is poured into the molds, to a transfer point or position 24, at which the castings are removed from their molds, or at which the molds with their castings therein are transferred from the pouring station to a heat treatment unit 26 or line for heat treatment. After the molten metal is poured into the mold, the mold is conveyed to the transfer position, where the metal is allowed to cool to a desired extent or temperature within the die as needed for the metal to solidify into the casting. The casting then is heat treated at a desired heat treatment temperature.

It has been discovered that, as the metal of the casting is cooled down, it reaches a temperature or range of temperatures referred to herein as the "process control temperature" or "process critical temperature", below which the time required to both raise the castings to the heat treating temperature and perform the heat treatment is significantly increased. It will be understood by those skilled in the art that the process control temperature for the castings being processed by the present invention will vary depending upon the particular metal and/or metal alloys being used for the castings, the size and shape of the castings, and numerous other factors.

In one aspect, the process control temperature may be about 400° C. for some alloys or metals. In another aspect, the process control temperature may be from about 400° C. to about 600° C. In another aspect, the process control temperature may be from about 600° C. to about 800° C. In yet another aspect, the process control temperature may be from about 800° C. to about 1100° C. In still another aspect, the process control temperature may be from about 1000° C. to about 1300° C. for some alloys or metals, for example, iron. In one particular example, an aluminum/copper alloy may have a process control temperature of from about 400° C. to about 470° C. In this example, the process control temperature generally is below the solution heat treatment temperature for most copper alloys, which typically is from about 475° C. to about 495° C. While particular examples are provided herein, it will be understood that the process control temperature may be any temperature, depending upon the particular metal and/or metal alloys being used for the castings, the size and shape of the castings, and numerous other factors.

Figure 1D:
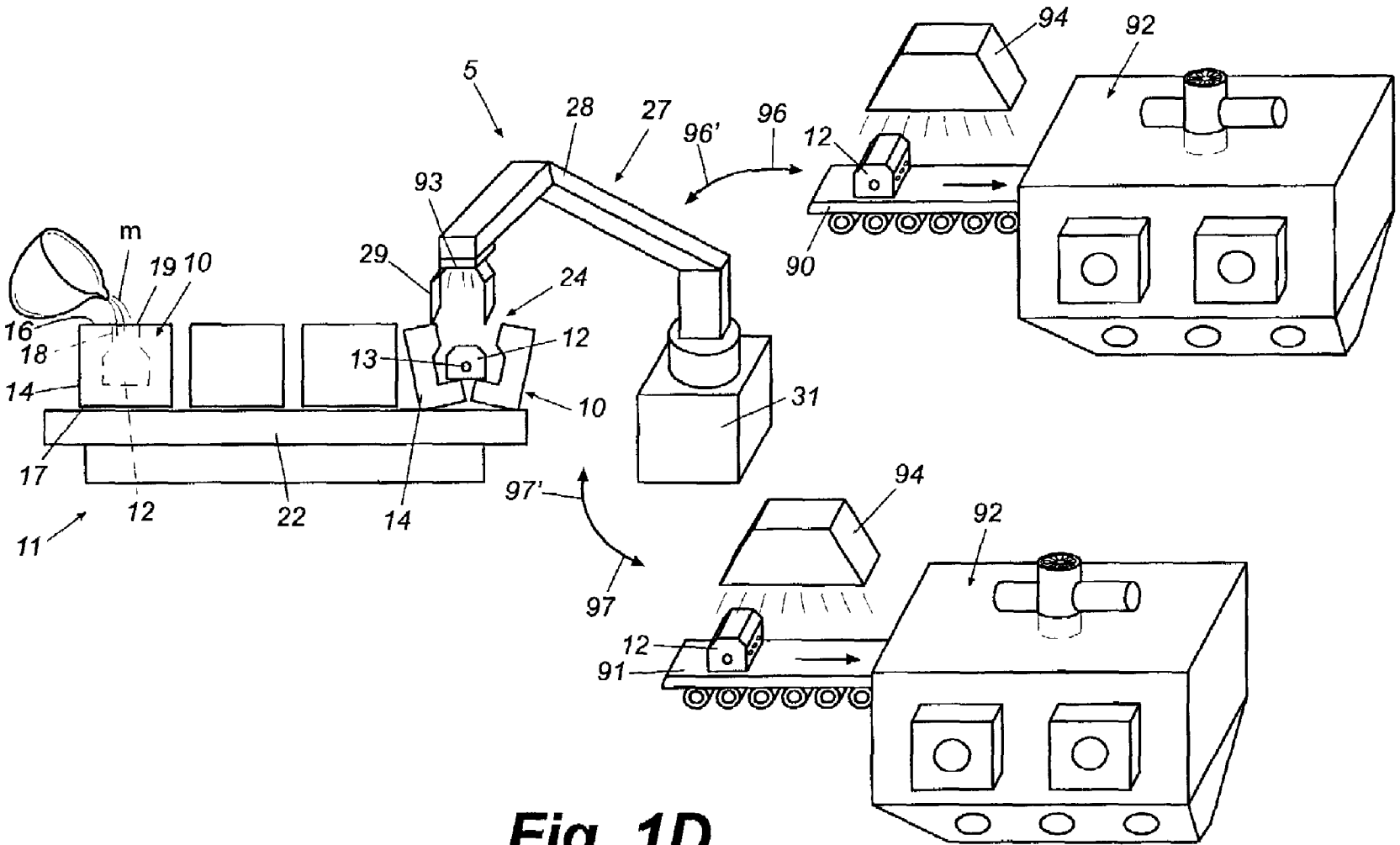
FIG. 1D is a schematic illustration of still another exemplary system according to various aspects of the present invention, illustrating a transfer mechanism including a heating device.

When the metal of the casting is within the desired process control temperature range, the casting typically will be cooled sufficiently to solidify as desired. However, if the metal of the casting is permitted to cool below its process control temperature, it has been found that the casting may need to be heated for at least about 4 additional minutes for each minute that the metal of the casting is cooled below the process control temperature to reach the desired heat treatment temperature, for example, from about 475° C. to about 495° C. for aluminum/copper alloys, or from about 510° C. to about 570° C. for aluminum/magnesium alloys. Thus, if the castings cool below their process control temperature for even a short time, the time required to heat treat the castings properly and completely may be increased significantly. In addition, it should be recognized that in a batch processing system, such as illustrated in FIGS. 1B, 1C, and 1D, where several castings are processed through the heat treatment station in a single batch, the heat treatment time for the entire batch of castings generally is based on the heat treatment time required for the casting(s) with the lowest temperature in the batch. As a result, if one of the castings in the batch being processed has cooled to a temperature below its process control temperature, for example, for about 10 minutes, the entire batch typically will need to be heat treated, for example, for at least an additional 40 minutes to ensure that all of the castings are heat treated properly and completely.

Various aspects of the present invention therefore are directed to an integrated processing facility or system 5 (FIG. 1A through FIG. 3) and methods of processing metal castings. The various systems are designed to move and/or transition the castings (within or apart from their molds) from the pouring station 11 to the heat treatment system or unit 26, while arresting cooling of the molten metal to a temperature at or above the process control temperature of the metal, but below or equal to the desired heat treatment temperatures thereof to allow the castings to solidify. Accordingly, various aspects of the present invention include systems for monitoring the temperature of the castings to ensure that the castings are maintained substantially at or above the process control temperature. For example, thermocouples or other similar temperature sensing devices or systems can be placed on or adjacent the castings or at spaced locations along the path of travel of the castings from the pouring station to a heat treatment furnace to provide substantially continuous monitoring. Alternatively, periodic monitoring at intervals determined to be sufficiently frequent may be used. Such devices may be in communication with a heat source, such that the temperature measuring or sensing device and the heat source may cooperate to maintain the temperature of the casting substantially at or above the process control temperature for the metal of the casting. It will be understood that the temperature of the casting may be measured at one particular location on or in the casting, may be an average temperature calculated by measuring the temperature at a plurality of locations on or in the casting, or may be measured in any other manner as needed or desired for a particular application. Thus, for example, the temperature of the casting may be measured in multiple locations on or in the casting, and an overall temperature value may be calculated or determined to be the lowest temperature detected, the highest temperature detected, the median temperature detected, the average temperature detected, or any combination or variation thereof.

Additionally, prior to entry into the heat treatment furnace, the castings may pass through an entry or rejection zone 110, where the temperature of each casting is monitored to determine whether the casting has cooled to an extent that would require and an excessive amount of energy to raise the temperature to the heat treatment temperature. The entry zone may be included in the process control temperature station, or may be a separate zone, as indicated generally throughout the various figures. The temperature of the casting may be monitored by any suitable temperature sensing or measuring device, such as a thermocouple, to determine whether the temperature of the casting has reached or dropped below a pre-set or predefined rejection temperature. In one aspect, the predefined rejection temperature may be a temperature (for example, from about 10° C. to about 20° C.) below the process control temperature for the metal of the casting. In another aspect, the predefined rejection temperature may be a temperature (for example, from about 10° C. to about 20° C.) below the heat treatment temperature of the heat treatment furnace or oven. If the casting has cooled to a temperature equal to or below the predefined temperature, the control system may send a rejection signal to a transfer or removal mechanism. In response to the detection of a defect condition or signal, the subject casting may be identified for further evaluation or may be removed from the transfer line. The casting may be removed by any suitable mechanism or device including, but not limited to, a robotic arm or other automated device, or the casting may be removed manually by an operator.

As with the above, it will be understood that the temperature of the casting may be measured at one particular location on or in the casting, may be an average temperature calculated by measuring the temperature at a plurality of locations on or in the casting, or may be measured in any other manner as needed or desired for a particular application. Thus, for example, the temperature of the casting may be measured in multiple locations on or in the casting, and an overall value may be calculated or determined to be the lowest temperature detected, the highest temperature detected, the median temperature detected, the average temperature detected, or any combination or variation thereof.

Figure 2A:
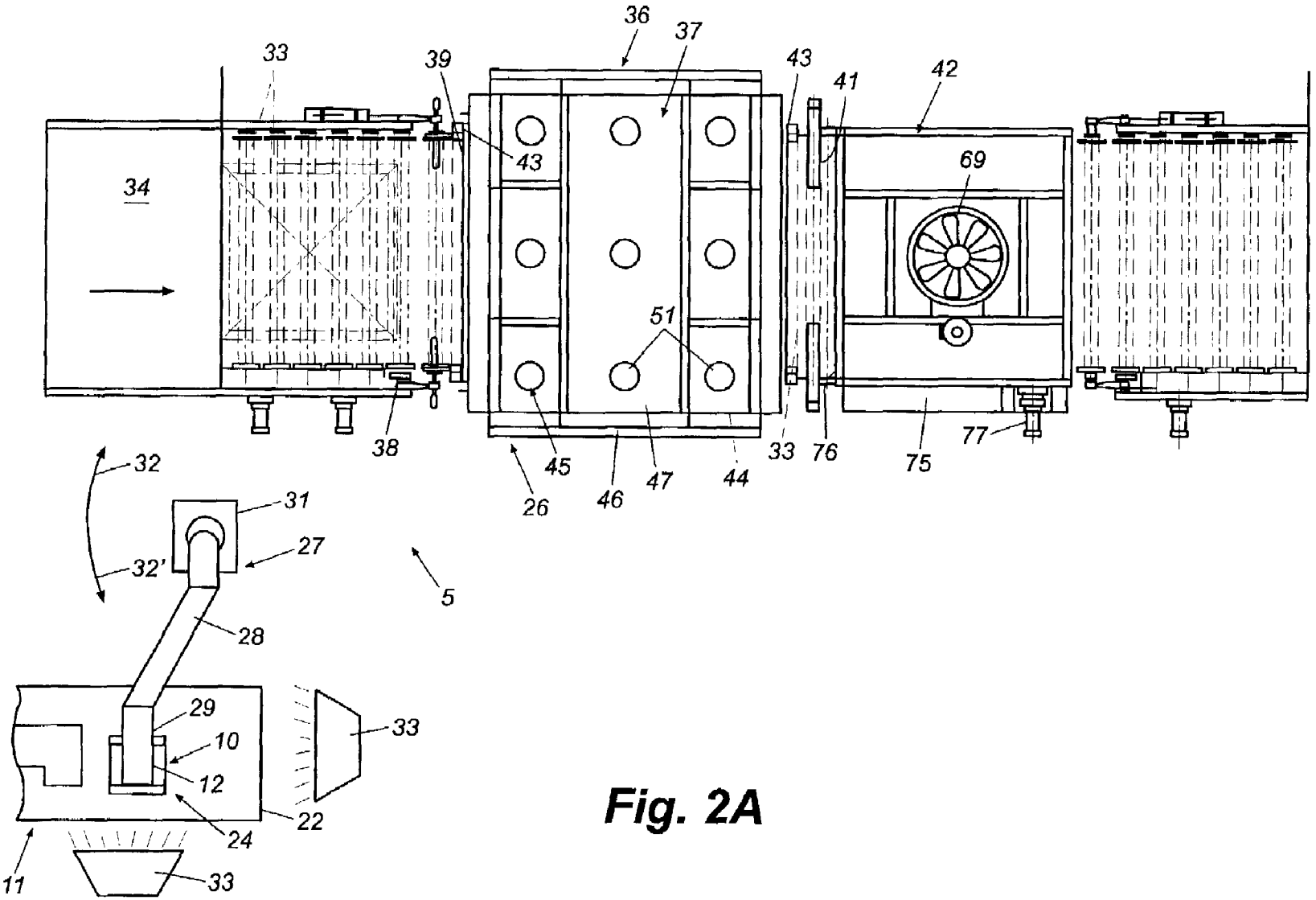
FIG. 2A is a top plan view of an exemplary process temperature control station and heat treatment station according to various aspects of the invention.
Figure 2B:
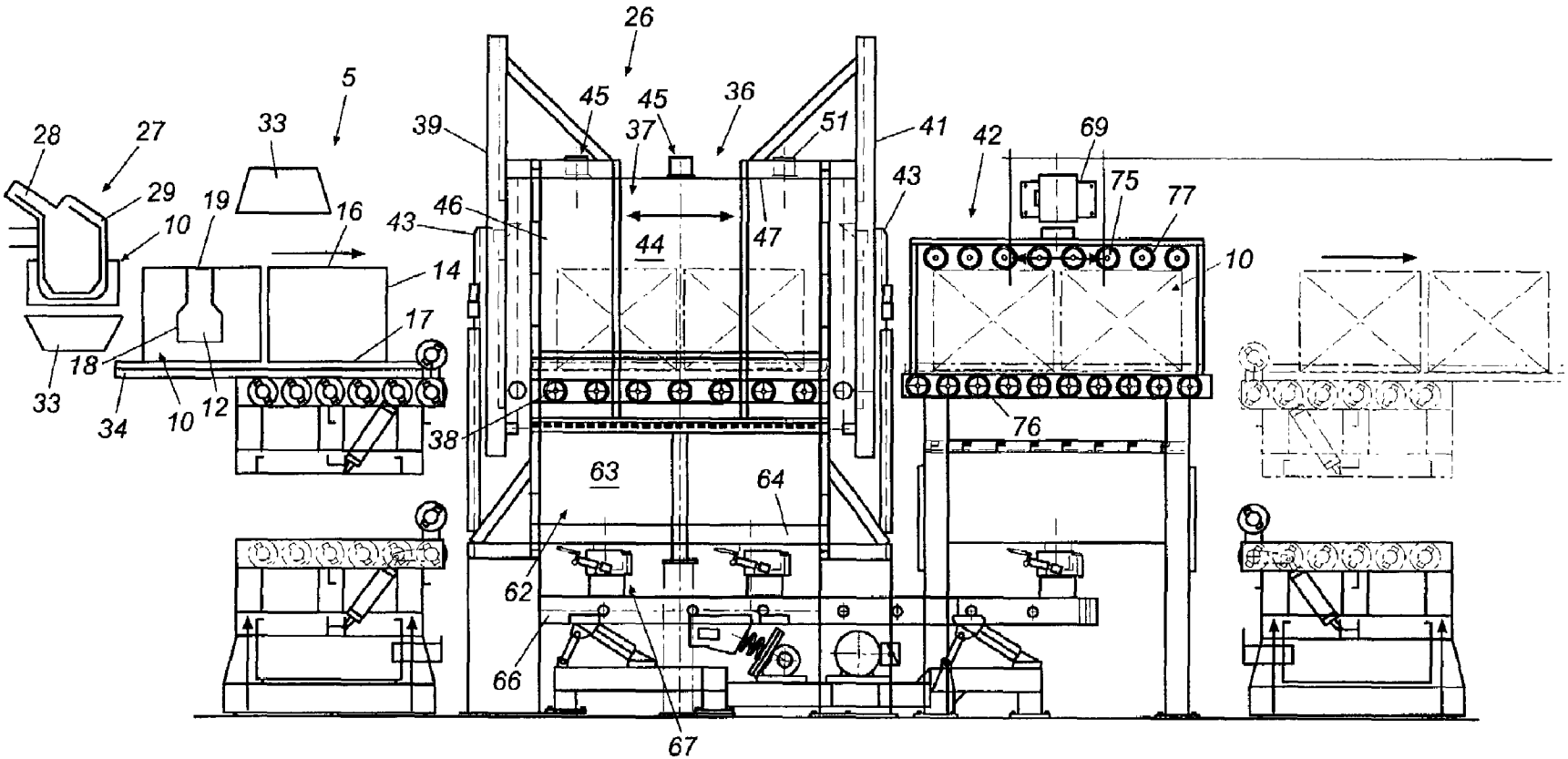
FIG. 2B is a side elevation view of the process temperature control station and heat treatment station depicted in FIG. 2A.
Figure 3:
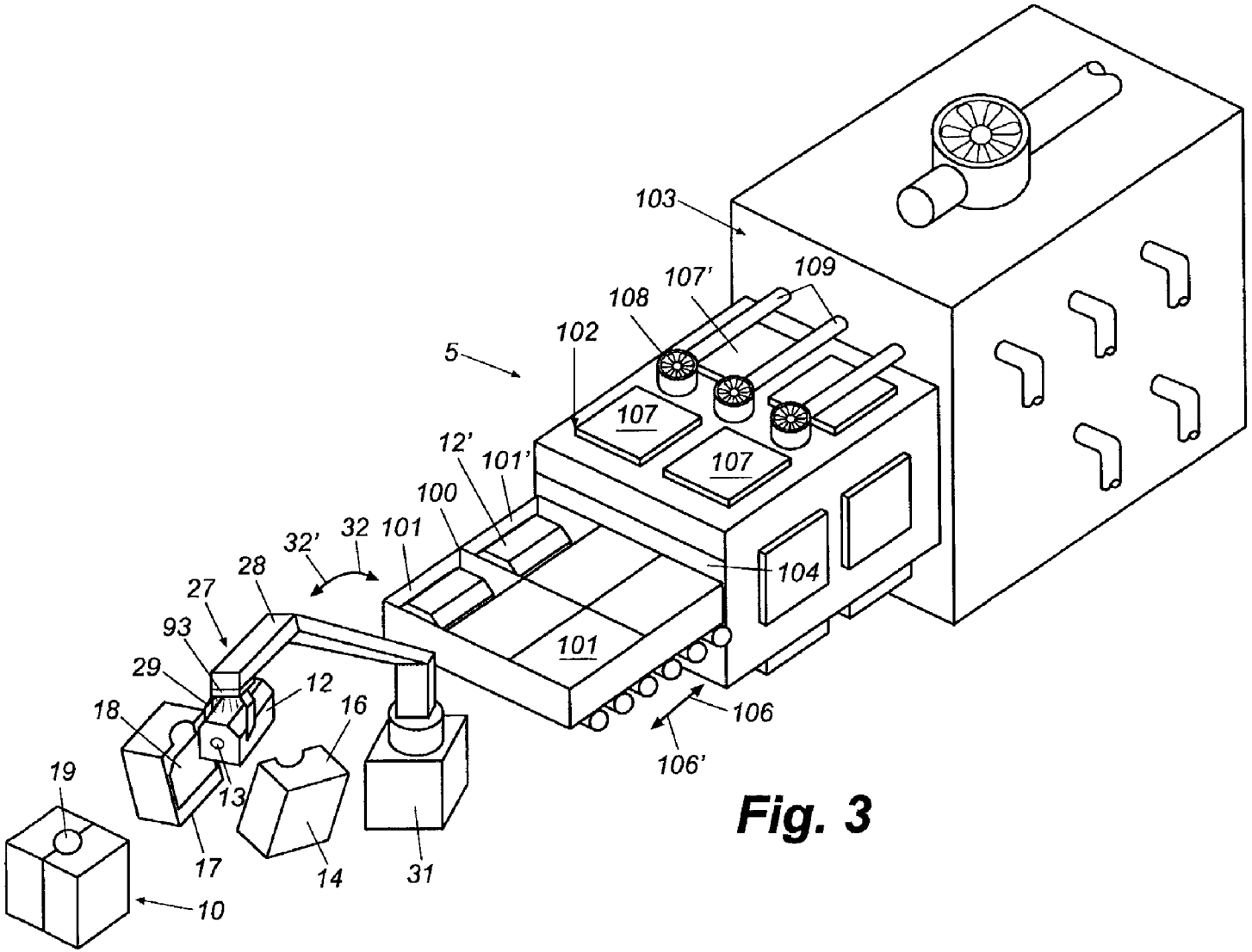
FIG. 3 is a perspective view of an exemplary batch processing system according to various aspects of the present invention.

A first embodiment of the integrated facility 5 and process for moving and/or processing castings therethrough is illustrated in FIGS. 1A, 2A, and 2B. FIG. 1B and FIG. 3 illustrate an additional, alternative embodiment of the integrated facility 5 and process for forming and treating castings where the castings are being collected and processed through heat treatment in a batch processing type arrangement. It will, however, be understood by those skilled in the art that the principles of the present invention can be applied equally to batch type and continuous processing type facilities in which the castings are processed individually through the facility and therefore the present invention. The embodiments described hereinafter therefore are not and should not be limited to continuous or batch-type processing facilities. FIG. 1C and FIG. 1D illustrate further alternative embodiments of the present invention for performing additional processing steps such as chill removal from castings (FIG. 1C) and feeding the castings to multiple heat treatment furnaces (FIG. 1D). In addition, it will be understood by those skilled in the art that various features of the embodiments discussed hereafter and illustrated in the drawings can be combined to form additional embodiments of the present invention.

In the exemplary system illustrated in FIGS. 1A, 2A, and 2B, the castings 12 generally are removed from their molds 10 at the transfer or pouring station 11 by a transfer mechanism 27. As indicated in FIGS. 2A and 2B, the transfer system or mechanism 27 typically includes a robotic arm or crane 28, although it will be understood by those skilled in the art that various other systems and devices for moving the castings and/or molds, such as an overhead boom or hoist, conveyor, pusher rods, or other similar material handling mechanisms also can be used. As indicated in FIGS. 1A, 1B, and 2A, the robotic arm 28 generally includes an engaging or gripping portion or clamp 29 for engaging and holding the molds or castings, and a base 31 on which the arm 28 is pivotally mounted to be movable between the transfer point 24 of the pouring station and the heat treatment line as indicated by arrows 32 and 32' (FIG. 2A). In addition, as shown in FIG. 1B, the transfer mechanism can be used to transfer molds and/or castings from multiple pouring stations 11 and 11' and can transfer the molds and/or castings to multiple heat treatment lines or units 26 (FIG. 1C).

The molds with castings therein typically are moved from the pouring station 11 to the pickup or transfer point 24 (FIG. 2A), where the transfer mechanism 27 generally will pick up the molds with their castings contained therein, or will remove the castings 12 from their molds and transport the castings to the heat treatment unit 26. Thus, the same manipulator or transfer mechanism can be used for removing the castings from the pouring station and for introducing the castings to the heat treatment unit. Typically, a heat source or heating element 33 will be positioned adjacent the transfer point 28 for the castings for applying heat thereto. The heat source typically can include any type of heating element or source such as conductive, radiant, infrared, conductive, convective, and direct impingement types of heat sources. As illustrated in FIG. 2A, multiple heat sources 33 can be used, positioned to most effectively apply heat to the castings during a transfer operation from the pouring station to the heat treatment line.

Typically, in the case of permanent or metal dies or molds, the molds will be opened at the transfer point and the castings removed by the transfer mechanism, as shown in FIG. 1D. The transfer mechanism then transfers the castings to one or more inlet conveyors 34 (FIGS. 1B and 2A) of the heat treatment unit, line(s), or system(s) 26 of the integrated processing facility 5. As the molds are opened and the castings removed, the heat sources 33 (FIG. 2A) apply heat directly to the castings to arrest or otherwise control the cooling of the castings during their exposure to the ambient environment of the foundry or plant, as the castings are being transferred to the heat treatment unit, to maintain the castings substantially at or above the process control temperature of the metal of the castings.

For the processing of castings that are being formed in semi-permanent or sand molds in which the castings typically remain within their molds during heat treatment, during which the molds are broken down by the thermal degradation of the binder material holding the sand of the mold, the transfer mechanism 27 may transfer the entire mold with the casting contained therein, from the transfer point to the inlet conveyor 34. The heat sources 33 thus may continue to apply heat to the mold itself, with the amount of heat applied being controlled to maintain the temperature of the castings inside the mold at levels substantially at or above the process control temperature of the metal of the castings without causing excessive or premature degradation of the molds.

Hereinafter, when reference is made to transport, heating, treating, or otherwise moving or processing the "castings", except where otherwise indicated, it will be understood that such discussion includes both the removal and processing of the castings by themselves, without their molds, and processes wherein the castings remain in their sand molds for heat treatment, mold and core breakdown, and sand reclamation as disclosed in U.S. Pat. Nos. 5,294,994; 5,565,046; 5,738,162; 6,217,317; and pending U.S. patent application Ser. Nos. 09/665,354, filed Sep. 9, 2000, and 10/051,666, filed Jan. 18, 2002, the disclosures of which are incorporated herein by reference in their entirety.

As illustrated in FIGS. 1A, 2A, and 2B, the castings initially are indexed or conveyed by the inlet conveyor 34 (FIGS. 2A and 2B), or conveyors 34 and 34' (FIG. 1B) into a pre-chamber or process temperature control station or module 36. As indicated in FIGS. 2A and 2B, the process temperature control station or module generally includes a heated inner chamber 37 through which the castings and/or molds with the castings therein are conveyed along their processing path along the heat treatment line on a chain conveyor, rollers, or similar conveying mechanism 38. The castings enter the chamber 37 at an upstream or inlet end 39, and exit the chamber 37 through a downstream or outlet end 41 and generally are introduced directly into a heat treatment furnace or station 42 of the heat treatment line 26. The inlet and outlet ends 39 and 41 of the process temperature control station can be open, or can include doors or similar closure structures, such as indicated at 43 in FIG. 2B, to help seal the chamber 37 to avoid undue loss of heat therefrom. Typically, the castings will be fed directly from the process temperature control station 36 into the heat treatment station 42, with the heat treatment and process temperature control stations being connected to further avoid potential loss of heat and, if desired, allow the sharing of heat.

The chamber 37 generally is a radiant chamber and includes a series of heat sources 45 mounted therewithin, including being positioned along the walls 46 and/or ceiling 47 of the chamber. Typically, multiple heat sources 45 may be used and may include one or more various different types of heat sources or heating elements, including radiant heating sources such as infrared, electromagnetic and inductive energy sources, conductive, convective, and direct impingement type heat sources, such as gas fired burner tubes introducing a gas flame into the chamber. In addition, the side walls and ceiling of the radiant chamber 37 may be formed from or coated with a high temperature radiant material, such as a metal, metallic film or similar material, ceramic, or composite material capable of radiating heat. The radiant coating generally forms a non-stick surface on the walls and ceilings. As the walls and ceiling of the chamber are heated, the walls and ceiling tend to radiate heat toward the castings, and at the same time, the surfaces generally is heated to a temperature sufficient to bum off waste gases and residue such as soot, etc., from the combustion of the binders of the sand molds and/or cores to prevent collection and buildup thereof on the walls and ceiling of the chamber.

Figure 4A:
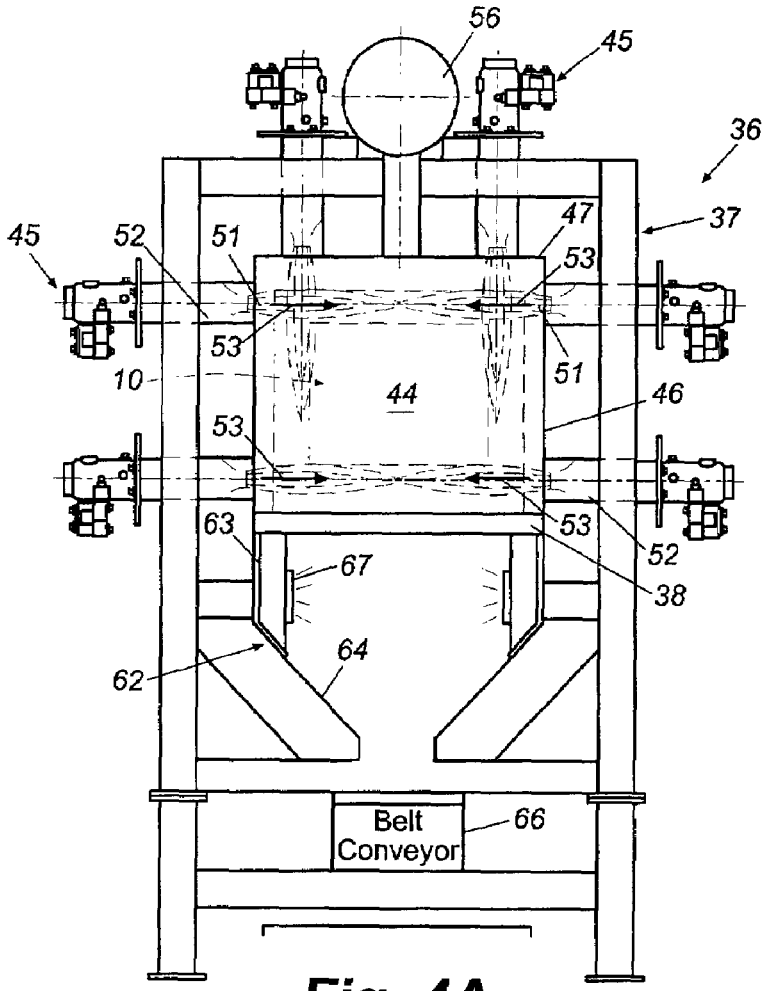
FIGS. 4A and 4B illustrate an exemplary process temperature control station including a convection heat source according to various aspects of the present invention.
Figure 4B:
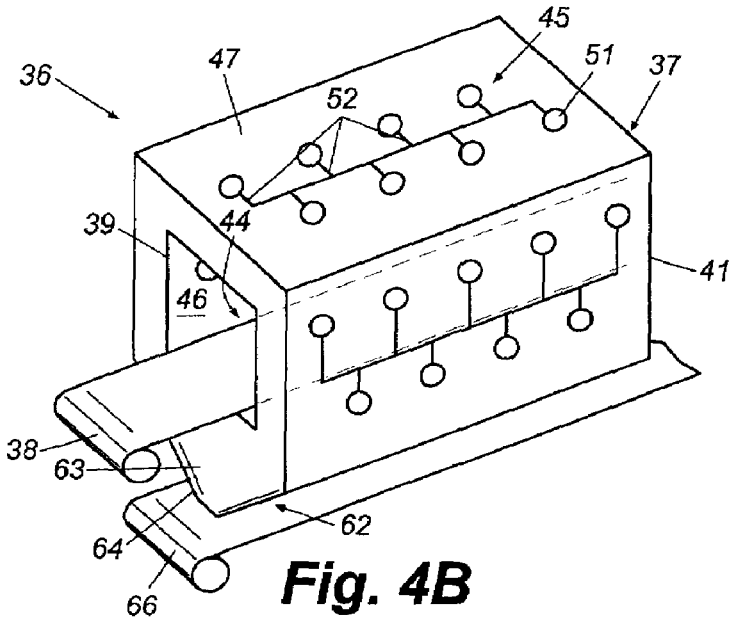

FIG. 4A through FIG. 6B illustrate various exemplary process temperature control stations. FIG. 4A and FIG. 4B illustrate a process temperature control station 36 including convection type heat sources 45. Each of the convection heat sources generally includes one or more nozzles or blowers 51 connected to a source of heated media by conduits 52. In this aspect, the blowers 51 are arranged or positioned about the ceiling 47 and side walls 46 of the chamber 37 to direct a heated media such as air or other gases, and/or fluids into the chamber and against the castings and/or molds contained therein. The convection blowers generally tend to create a turbulent heated fluid flow about the castings, as indicated by arrows 53, to apply heat substantially to all sides of the castings and/or sand molds. As a result, the temperature of the castings is maintained substantially at or above the process control temperature of the metal thereof. In addition, where the castings are processed in their sand molds, the application of heat within the process temperature control station tends to heat the molds, raising their temperature towards a decomposition or combustion temperature at which the binder materials therein start to combust, pyrolyze, or otherwise be driven off.

In another aspect, the blowers or nozzles 52 are positioned at the front of the process temperature control station adjacent the inlet end thereof, operating at higher velocities and/or temperatures to arrest more quickly the cooling of the castings and/or molds. The nozzles or blowers 52 positioned toward the middle and/or end of the chamber, such as at the outlet of the process temperature control station, can be run at lower temperatures and velocities to prevent complete degradation of the sand molds while allowing the castings to solidify.

Figure 5A:
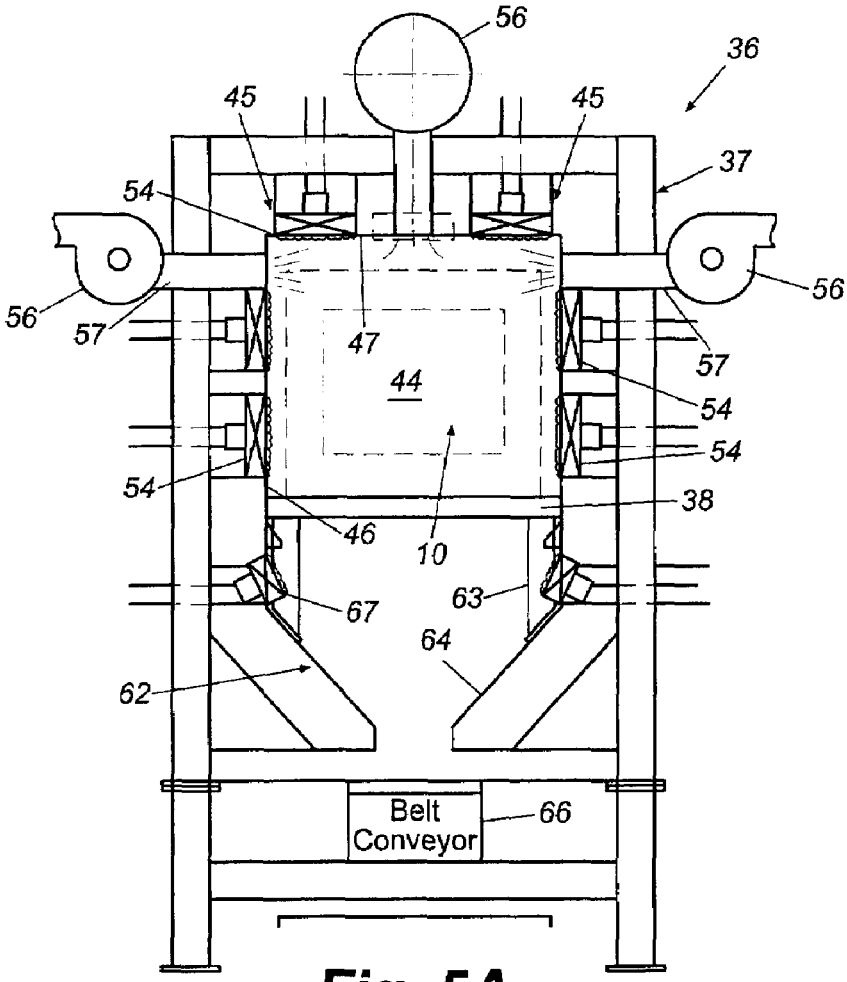
FIGS. 5A and 5B illustrate another exemplary process temperature control station including a direct heat/impingement heat source according to various aspects of the present invention.
Figure 5B:
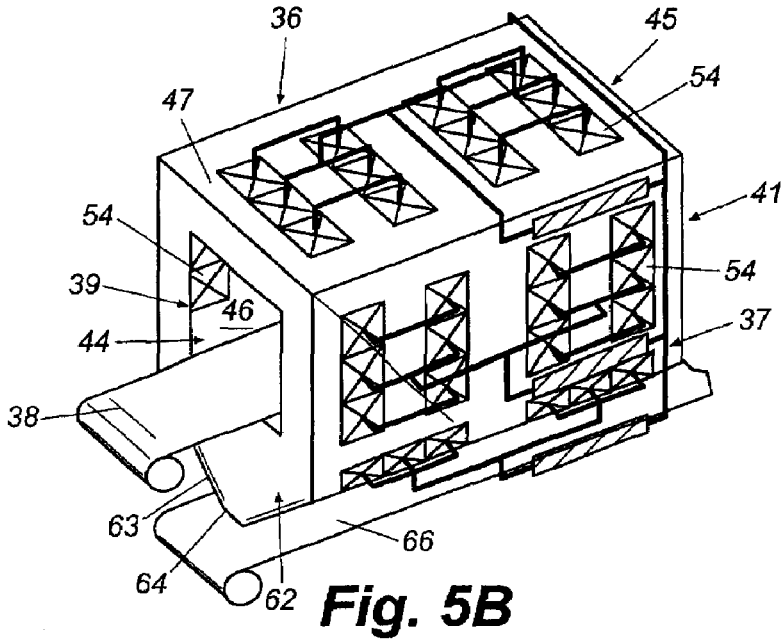

Alternatively, FIGS. 5A and 5B illustrate another exemplary process temperature control station 36' in which the heat sources 45' generally comprise one or more radiant heaters 54, such as infrared heating elements, electromagnetic energy sources, or similar radiant heating sources. In one aspect, the radiant heaters 54 are arranged in multiple positions or sets at desired locations and orientations about the walls and ceiling 46 and 47 of the radiant chamber 37 of the process temperature control station 36, for example, similar to the arrangement of the convection blowers 51. As with the convection heat sources 52, the radiant heaters adjacent the inlet end of the chamber can be operated at higher temperatures to more quickly arrest the cooling of the castings in their sand molds as they enter the process temperature control station. In addition, vacuum blowers, pumps, or exhaust fans/systems 56 may be connected to the radiant chamber through conduits 57 to create a negative pressure within the radiant chamber 37. In doing so, heat and/or waste gases generated from the burning or combustion of the binder of the sand cores and/or sand molds are drawn from the chamber to prevent overheating of the radiant heater elements.

Figure 6A:
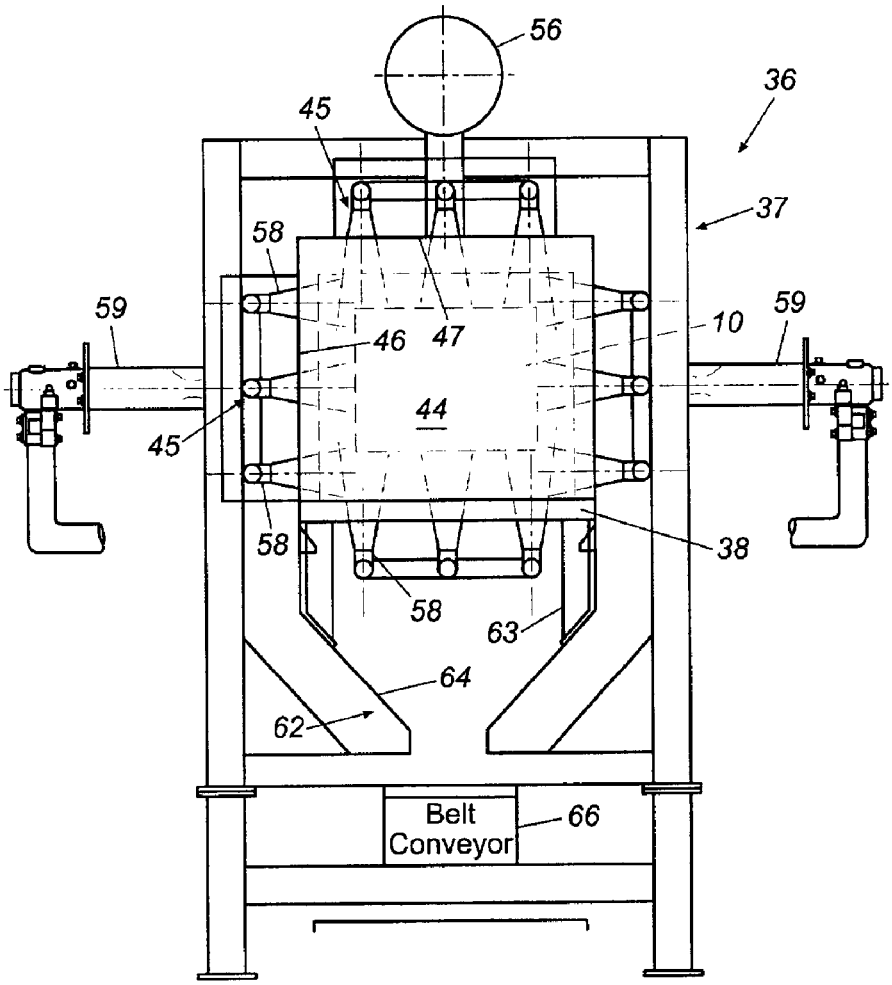
FIGS. 6A and 6B illustrate another exemplary process temperature control station including a radiant heat source according to various aspects of the present invention.
Figure 6B:
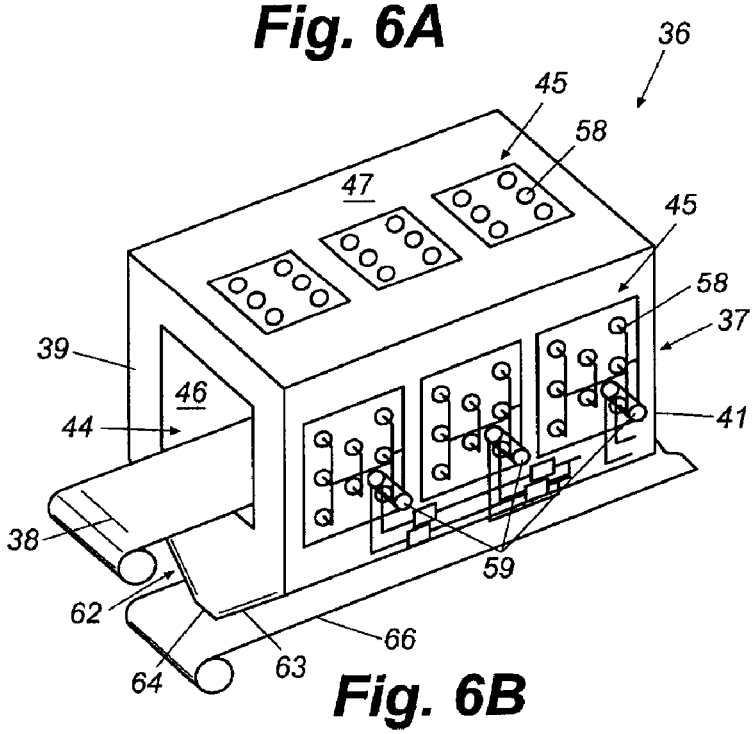

Still another exemplary process temperature control station 36" is provided in FIGS. 6A and 6B, which illustrate a direct impingement type of heating source 45". The direct impingement heat source includes a series of burners or nozzles 58 arranged in sets or arrays at selected positions or orientations within the radiant chamber 37. These burners 58 generally are connected to a fuel source, such as natural gas or the like, by conduits 59. The nozzles or burner elements of the direct impingement heat source direct and apply heat substantially toward the sides, the top, and the bottom of the castings. The castings thus are heated substantially uniformly, and the sand material released therefrom further can be exposed to direct heating for burning off of the binder material thereof.

It will be understood by those skilled in the art that different heating sources can be combined for use in the radiant chamber. Further, multiple chambers can be used in series to arrest the cooling of the castings substantially at or above the process control temperature, and thereafter maintain the temperature of the castings prior to entry into the heat treatment station.

In another aspect, the off-gases generated when pouring the molten metal may be directed into the radiant chamber of the process temperature control station 36, as indicated by arrows 60 to allow for shared heating and recuperation of energy from the heating of the metal for the castings. In yet another aspect, excess heat generated as a result of the break-down and combustion of the binder for the sand cores of the castings and/or sand molds within the heat treatment station 42 and the heat treatment of the castings also can be routed back to the process temperature control station, as indicated by dashed arrows 61 in FIG. 1A, to help heat the interior environment of the radiant chamber of the process temperature control station. Such recapture of waste gases and heat helps reduce the amount of energy required to heat the chamber of the process temperature control station to a desired or necessary temperature to arrest the cooling of the castings passing therethrough.

As additionally indicated in FIGS. 2B, 4A, 5A and 6A, a collection hopper or chute 62 may be formed along the bottom of the process temperature control station 36, positioned below the radiant chamber 37 thereof. This hopper 62 generally includes side walls 63 that slope downwardly at the lower ends 64 thereof. The sloping side walls collect sand dislodged from the sand cores of the castings and/or sand molds as the thermal degradation of the binder thereof begins within the process temperature control station. The sand typically is directed downwardly to a collection conveyor 66 positioned below the open lower end of the hopper 62. Typically, a fluidizing system or mechanism 67 is positioned along lower portions 64 of the walls of the hopper 62. The fluidizer(s) typically includes burners, blowers, distributors or similar fluidizing units, such as disclosed and claimed in U.S. Patent Nos. 5,294,994; 5,565,046; and 5,738,162, incorporated herein by reference, that apply a flow of a heated media such as air or other fluids to the sand to promote further degradation of the binder to help break up any clumps of sand and binder that may be dislodged from the castings to help reclaim the sand of the sand cores and/or sand molds for the castings in a substantially pure form. The reclaimed sand is collected on the conveyor 66 and conveyed away from the process temperature control station.

In addition, as illustrated in FIG. 1A, 2A, 2B, 4A, 5A, and 6A, excess heat and waste gases generated by the combustion of the binder materials for the sand cores and/or sand molds of the castings can be collected or drawn out of the radiant chamber 37 of the process temperature control station 36 and routed into the heat treatment station 42 as indicated by arrows 68 in FIG. 1A. This channeling of excess heat and waste gases from the process temperature control station into the heat treatment station enables both the potential recouping of heat generated within the chamber of the process temperature control station and the further heating and/or combustion of waste gases resulting from the degradation of the binders of the sand molds and/or cores within the heat treatment chamber. As indicated in FIG. 1A, blowers or similar air distribution mechanisms 69 further generally are mounted along the heat treatment station and typically will draw off waste gases generated during the heat treatment of the castings and the resulting bum-off of the binder materials from the sand cores and/or sand molds of the castings. These waste gases are collected by the blowers and typically are routed to an incinerator 71 for further treating and burning these waste gases to reprocess these gases and reduce the amount of pollution produced by the casting and heat treatment process. It is also possible to utilize filters to further filter the waste gases coming from either the process temperature control station prior to their being introduced into the heat treatment station and/or or for filtering gases coming from the heat treatment station to the incinerator.

The process temperature control station consequently functions as a nesting area in front of the heat treatment station or chamber in which the castings can be maintained with the temperature thereof being maintained or arrested at or above the process control temperature, but below a desired heat treating temperature while they await introduction into the heat treatment station. Thus, the system allows the pouring line or lines to be operated at a faster or more efficient rate without the castings having to sit in a queue or line waiting to be fed into the heat treatment station while exposed to the ambient environment, resulting in the castings cooling down below their process control temperature. The castings thereafter can be fed individually, as indicated in FIGS. 1A, 1C, 2A, and 2B, or in batches, as shown in FIGS. 1B, 1C and 3, into the heat treatment station 42 for heat treatment, sand core and/or sand mold breakdown and removal, and, in some instances, for sand reclamation.

The heat treatment station 42 (FIG. 2B) may be an elongated furnace that includes one or more furnace chambers 75 mounted in series, through which a conveyor 76 is extended for transport of the castings therethrough. Heat sources 77 (FIG. 2A) including convection heat sources such as blowers or nozzles that apply heated media such as air or other fluids, conduction heat sources such as a fluidized bed, inductive, radiant and/or other types of heat sources may be mounted within the walls and/or ceiling of the chamber 75 for providing heat and optional airflow about the castings in varying degrees and amounts to heat the castings to the proper heat treating temperatures. Such desired heat treating temperatures and heat treatment times will vary according to the type of metal or metal alloy from which the castings are being formed, as will be known to those skilled in the art.

Examples of various heat treatment furnaces that may be suitable for use with the present invention include those described in U.S. Pat. Nos. 5,294,994; 5,565,046; and 5,738,162, the disclosures of which are hereby incorporated by reference. A further example of a heat treatment furnace or station for use with the present invention is illustrated and disclosed in U.S. Pat. No. 6,217,317 and U.S. patent application Ser. Nos. 09/665,354, filed Sep. 9, 2000, and 10/051,666, filed Jan. 18, 2002, the disclosures of which are likewise incorporated herein by reference in their entirety. Such heat treatment stations or furnaces may include features for reclaiming the sand from the cores and/or molds dislodged during heat treatment of the castings.

After heat treating, the castings typically are removed from the heat treatment station and moved to a quenching station 78 (FIG. 1A) for cleaning and further processing. The quenching station typically includes a quench tank having a cooling fluid such as water or other known coolant, or can comprise a chamber having a series of nozzles that apply cooling fluids such as air, water, or similar cooling media. Thereafter, the castings may be removed for further cleaning and processing as needed.

Another exemplary integrated facility 5 is illustrated in FIG. 1B. The facility 5 includes a transfer mechanism 27, illustrated as a crane or robotic arm 28, that removes the castings from multiple pouring lines or stations 11 and 11'. In this example, the pouring lines or stations 11 and 11' are illustrated as a carousel type system in which the molds are rotated between pouring or casting positions 23 and a transfer point 24. The transfer mechanism 27 either engages and transports the sand molds with their castings therein, or removes the castings from the molds and transfers the castings to one or more inlet conveyors 34 and 34' of the heat treatment unit 26. The castings can be moved individually into and through the process temperature control station 36 for introduction into the heat treatment station 42, or can be collected in baskets or conveying trays 79 for processing the castings in batches.

In the exemplary system 5 illustrated in FIG. 1B, the process temperature control station 36 generally is formed as an elongated radiant tunnel 81 defining a chamber 82 through which the castings and/or sand molds with castings contained therein are moved or conveyed. The radiant tunnel 81 includes a series of heat sources 83 mounted therealong, such as the various different heating sources 45, 45', and 45" discussed above with respect to the embodiments of FIGS. 2A, 2B, and 4A through 6B. Typically, the walls 84 and ceiling of the chamber 82 of the radiant tunnel 81 are formed from or are coated with a refractory material so that the heat generated within the radiant tunnel is reflected and/or radiated towards the castings. The castings may be collected and/or deposited into a basket 79 or similar conveying tray in a collection station 86 at the end of the radiant tunnel 81. Such baskets 79 or trays may be used to contain the casting and/or molds through the heat treatment station 42. The castings alternatively may be collected within the baskets for batch processing in the heat treatment station before the castings are passed through the radiant chamber or tunnel of the process temperature control station 36, as indicated in FIG. 1C and FIG. 3.

Still another exemplary integrated facility 5 according to the present invention is illustrated schematically in FIG. 1C. In this embodiment, the process temperature control station 36, shown as an elongated radiant tunnel or chamber 81 (as discussed with respect to FIG. 1B), connects or feeds into a chill removal station 87. The chill removal station 87 is in communication with and feeds the castings into the heat treatment station 42. Typically, the castings will be moved and heat-treated or processed while still contained within their semi-permanent or sand molds, which further include "chills" mounted therein. Chills generally are metal plates, typically formed from steel or similar material, having a design relief for forming desired design features of a casting surface and are placed within the molds at or prior to the pouring of the molten metal material therein. The chills consequently must be removed prior to heat treatment of the castings or reclamation of the chills and reuse. After passing through the chamber 82 of the radiant tunnel 81 during which the combustion of the sand molds generally will at least partially have begun, the chills easily can be removed without significantly delaying the movement of the molds and castings into the heat treatment station 42. Following the removal of the chills in the chill removal station, the molds with their castings within generally are passed directly into the heat treatment station for heat treatment, sand core and sand mold breakdown, and sand reclamation.

FIG. 1D illustrates yet another exemplary facility according to the present invention. In this embodiment, the castings generally can be removed from their molds and transported to an inlet conveyor 90 or 91 for being fed directly into one or more heat treatment furnaces or stations 92. Alternatively, if the castings are being formed within sand molds, the entire mold will be transported from the transfer point 28 to one of the inlet conveyors 90 or 91. As indicated in FIG. 1D, the removal of the castings from their molds and subsequent transfer of the castings, or the removal of the molds with the castings remaining therein from the pouring station and transport to the heat treatment stations 92, generally can be done by the same transport mechanism or manipulator.

In this embodiment, a heat source 93 is mounted to the transfer mechanism 27 for applying heat directly to the castings and/or sand molds as the castings are moved from the transfer points of the pouring lines to one of the inlet conveyors 90 or 91 for a heat treatment furnace 92. The heat source, as discussed above, may include a radiant energy source such as infrared or electromagnetic emitters, inductive, convective, and/or conductive heat sources, or other types of heat sources as will be apparent to those skilled in the art. The heat from the heat source 93 mounted to the transfer mechanism 27 is directed at one or more surfaces such as the top and/or sides of the castings or molds as the castings or molds are transferred to the inlet conveyor to arrest the cooling of the castings and/or molds, and thus maintain the temperature of the casting metal substantially at or above the process control temperature of the metal.

Additional heat sources 94 may be mounted above or adjacent the inlet conveyors 90 and 91 as indicated in FIG. 1D, or along the paths of travel of the transfer mechanism as indicated by arrows 96, 96', 97, and 97' to maintain the temperature of the castings. In addition, blowers, fans or other similar air movement devices (not shown) also can be positioned adjacent the transfer mechanism or along its path of movement 96, 96', 97, and 97' for applying a heated media, such as air or other heated fluids, thereto. The blowers distribute the heat applied to the casting and/or mold to minimize uneven heating or cooling of the castings during transfer from the pouring line to the heat treatment furnace(s) 92. The use of such heat sources or elements mounted on the transfer mechanism and, in some arrangements, along the path of travel of the castings, thus performs the function of the process temperature control station to help arrest cooling and maintain the castings substantially at or above the process control temperature.

Still another aspect of the present invention is illustrated in FIG. 3. In this example, the castings and/or sand molds are placed directly within collection baskets or conveying tray 100 by the transfer mechanism 27 and fed into the process temperature control station for a batch heating process. In such an arrangement, the castings 12 generally will be loaded into a series of compartments or chambers 101 of the conveying tray 100, with the castings located in known, indexed positions for directed application of heat for decoring and other functions as the castings are moved into and through a process temperature control station 102 and heat treatment station 103, as disclosed and claimed in U.S. patent application Ser. No. 09/665,354, filed Sep. 9, 2000, incorporated herein by reference in its entirety. In this embodiment, the trays 100 typically will be indexed into and out of the chamber 104 of the process temperature control station as indicated by arrows 106 and 106"as the castings are loaded therein. As a result, the exposure of the castings to the ambient environment, which would allow them to cool down below their process control or critical temperature, is minimized while the various other compartments 101 of the tray are loaded with the remaining castings of the batch.

In addition, as indicated in FIG. 3, it is further possible to provide directed heat sources 107 for each of the compartments 101 of the trays 100. For example, as a first compartment 101' is loaded with a casting 12' and indexed into the process temperature control station 102, a first heat source 107' directs heat toward the casting and/or sand mold within that particular chamber. Thereafter, as successive castings or molds are loaded into the other chambers or compartments of the basket, additional heat sources 107 directed to those compartments are engaged. Thus, the heating of the chamber 104 of the process temperature control station can be limited or directed to specific regions or zones as needed for more efficient heating of the castings.

As FIG. 3 further illustrates, a series of blowers or other similar air movement devices 108 may be mounted to the roof of the process temperature control station for drawing off waste gases generated by the degradation of the sand core and/or sand mold binder materials. The gases and additional waste heat then may be directed via conduits 109 to the heat treatment station 103 for heat reclamation and pollution reduction, and to help prevent the collection of combustible wastes on the sides and ceiling of the chamber of the process temperature control station 102.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

While the present invention is described herein in detail in relation to specific aspects, it is to be understood that this detailed description is only illustrative and exemplary of the present invention and is made merely for purposes of providing a full and enabling disclosure of the present invention. The detailed description set forth herein is not intended nor is to be construed to limit the present invention or otherwise to exclude any such other embodiments, adaptations, variations, modifications, and equivalent arrangements of the present invention, the present invention being limited solely by the claims appended hereto and the equivalents thereof.

What is claimed is:

1. An integrated system for forming and heat treating a metal casting, the system comprising:

a pouring station for pouring molten metal into a mold to form the casting;

a heat treatment station downstream from said pouring station and including a heat treatment furnace for receiving the casting;

a temperature measuring device for monitoring the temperature of the casting as it is transferred from said pouring station to said heat treatment station;

a transfer mechanism adjacent said pouring station and in communication with said temperature measuring device, for transferring the casting between said pouring station and said heat treatment station; and at least one heat source along a path of travel of the casting as the casting is transferred from said pouring station to said heat treatment station, said at least one heat source located in a position to apply heat to the casting as needed in response to said temperature measuring device monitoring the temperature of the casting in order to maintain the casting at or above a process control temperature, but below a solution heat treatment temperature for the metal of the casting, to enable solidification of the molten metal sufficient to form the casting; and wherein the process control temperature is a temperature below which for every one minute of time a temperature of the casting decreases, more than one minute of heat treatment time thereafter is required to attain a desired heat treatment properties of the casting.

2. The integrated system of claim 1, and further comprising a controller in communication with said temperature measuring device and said at least one heat source, said controller controlling the amount of heat applied to the casting to maintain the temperature of the castings at or above the process control temperature for the metal of the casting.

3. The integrated system of claim 1, wherein said at least one heat source applies heat to the casting sufficient to arrest the cooling of the casting without heating the casting above the heat treatment temperature for the metal of the casting.

4. The integrated system of claim 1, wherein said heat treatment station further comprises an entry zone having a temperature measuring device, and wherein if the casting is below a pre-defined rejection temperature, the casting can be removed from said heat treatment station prior to entry into said heat treatment furnace.

5. The integrated system of claim 1, and further comprising a process control temperature station between said pouring station and said heat treatment station for arresting cooling of the casting and maintaining the temperature of the casting at or above its process control temperature.

6. An integrated metal processing facility for forming castings from a molten metal material and thereafter heat treating the castings, comprising:

a pouring station at which the molten metal material is introduced into a series of molds to form the castings;

a heat treatment station positioned along a processing path for the castings, downstream from said pouring station, and including at least one chamber for heat treating the castings;

at least one heat source positioned along said processing path for the castings between said pouring station and said heat treatment station for applying heat to the castings during transitioning of the castings from said pouring station to said heat treatment station; and a temperature control system, in communication with said at least one heat source for controlling application of heat to the castings by said at least one heat source as needed to substantially maintain the castings at or above a predetermined process control temperature for the metal of the castings and below a solution heat treatment temperature for the metal of the castings after pouring, whereby the molten metal of the castings is permitted to at least partially solidify sufficient to form the castings, while the castings are maintained at or above said process control temperature so as to substantially minimize a time necessary to heat the castings to a solution heat treatment temperature required for heat treatment of the castings.

7. The integrated metal processing facility of claim 6 and further comprising a transfer mechanism for transferring the casting from said pouring station to said process control temperature station, and wherein said at least one heat source is mounted on said transfer mechanism and is moveable therewith.

8. The integrated metal processing facility of claim 6 and further comprising a process control temperature station in which said at least one heat source and a temperature sensing device are located.

9. The integrated metal processing facility of claim 8 and wherein said process control temperature station comprises a chamber and wherein said at least one heat source comprises a series of burners connected to a fuel source for applying heat to the casting.

10. The integrated metal processing facility of claim 8 and wherein said process control temperature station comprises a chamber and wherein said at least one heat source comprises a convection heater.

11. The integrated metal processing facility of claim 8 and wherein said process control temperature station comprises a radiant chamber having a plurality of radiant heat sources positioned therealong.

* * * * *